United States Patent [19]

Haussmann

[11] Patent Number: 4,696,355

[45] Date of Patent: Sep. 29, 1987

[54] DRILLING TOOLS

[75] Inventor: August Haussmann, Oberzell, Fed. Rep. of Germany

[73] Assignee: Hawera Probst GmbH & Co., Ravensburg, Fed. Rep. of Germany

[21] Appl. No.: 816,577

[22] Filed: Jan. 6, 1986

[30] Foreign Application Priority Data

Jan. 5, 1985 [DE] Fed. Rep. of Germany ..... 3500202

[51] Int. Cl.[4] ..... E21B 10/36; E21B 10/44

[52] U.S. Cl. ..... 175/395; 175/410; 175/414; 407/42; 408/230

[58] Field of Search ..... 175/394, 395, 410, 414, 175/415, 323, 327; 408/230, 229, 210, 226, 144; 407/42, 53, 54

[56] References Cited

U.S. PATENT DOCUMENTS 3,718,067 2/1973 Fischer ..... 175/323
3,845,829 11/1974 Schaumann ..... 175/395
4,314,616 2/1982 Rauckhorst et al. ..... 175/394

FOREIGN PATENT DOCUMENTS 520130 2/1931 Fed. Rep. of Germany ..... 175/394
1027608 8/1953 Fed. Rep. of Germany ..... 175/410
1118255 6/1956 France .
776353 6/1957 United Kingdom ..... 175/410

*Primary Examiner*—James A. Leppink
*Assistant Examiner*—Hoang C. Dang
*Attorney, Agent, or Firm*—Spencer & Frank

[57] ABSTRACT

A drilling tool for percussion drilling machines is proposed which has an increased endurance strength or fatigue strength when used in percussion drilling machines having a high striking speed. For this purpose, the carbide cutting tip (11) is arranged transversely to the flute runout (12, 13) so that the effective moment of resistance area in the area of the groove root (22) of the recessed groove (14) is not weakened by flute runout surfaces.

5 Claims, 15 Drawing Figures

Figure 4A:
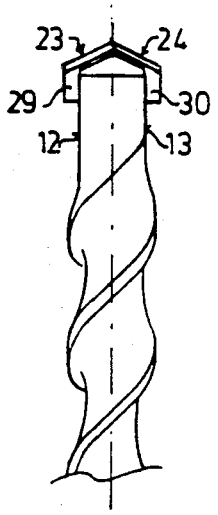

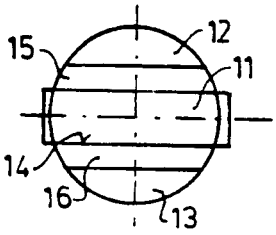
FIG 1a
PRIOR ART
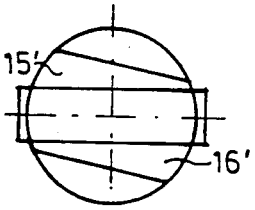
FIG 1b
PRIOR ART
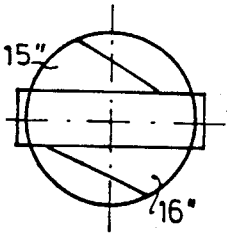
FIG 1c
PRIOR ART
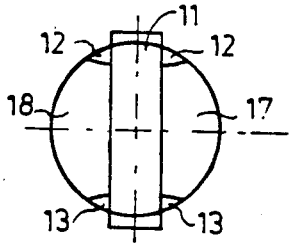
FIG 2
FIG 3
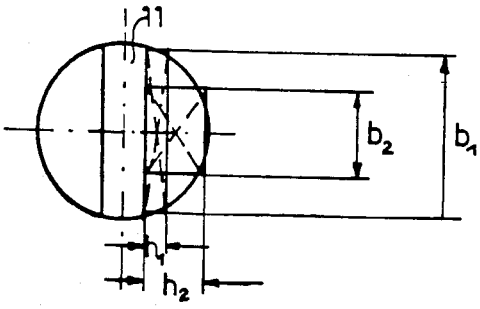

DRILLING TOOLS

The invention relates to a drilling tool for percussion drilling machines, preferably having double helical fluting, on the point of which a carbide cutting tip, preferably having two cutting faces, is inserted transversely to the axial longitudinal direction of the drilling tool.

Drilling tools for use in percussion drilling machines are equipped with a carbide cutting tip on the drill head. In known drilling tools, this carbide cutting tip is inserted parallel to the flute runout of, for example, a double helical fluting (See FIG. 1*a*). For this purpose, a transverse groove is made in the helical body, into which groove is brazed the carbide cutting tip.

To increase the strength against chipping of the cutting tip, the flute runout at the drill head was formed unsymmetrical relative to the cutting tip, so that the cutting tip receptacle was made thicker in the area of greater stresses (See FIGS. 1*b* and 1*c*).

The known drilling tools are used in both percussion drilling machines of the higher weight class (e.g. 4 kg) and in percussion drilling machines of the light weight class (e.g. 2 kg). In the percussion drilling machines of the light class, the impacting mass, which is smaller compared with the heavy class, is compensated by the striking pin acting on the drilling tool at higher speed. The requisite energy is therefore achieved with increased speed of the striking pin.

When using the known drilling tools in percussion drilling machines of the light class, it has been shown that the drilling tools have shorter tool lives than under the same load in percussion drilling machines of the heavy class. The lower fatigue strength is due to higher stress concentration in the drill head, caused by the high impact speed in percussion drilling machines of the lighter class.

The object of the invention is to create a drilling tool which has an increased endurance strength or tool life when used in percussion drilling machines having a higher striking speed.

This object is achieved by the innovation described below.

The central idea of the present invention lies in a fundamental reconstruction of the drill head from conventional drilling tools, in particular in order to increase the moment of resistance of the load-bearing or supporting area. In conventional drilling tools, the carbide cutting tip is in principle inserted in the drill head parallel to the flute runout (See FIG. 1*a*). This way, only a small web remains as a lateral support for the cutting tip.

In the present invention, on the other hand, the carbide cutting tip is inserted into the drill head such that it is turned through 90° as compared with the arrangement in conventional drilling tools (See FIG. 2). In this way, the moment of resistance of the lateral support surface is considerably increased, which leads to longer tool life or to increased fatigue strength of the drilling tool.

Furthermore, the drilling tool according to the invention has the advantage that the end areas of the carbide cutting tip project directly into the flute runout surface. The drilling dust produced by the carbide cutting tip is fed into he flute runout surface of the drilling dust flutes directly in the originating area without it being necessary to deflect the drilling dust as in conventional drilling tools. Disposal of the drilling dust is therefore fully guaranteed even in the changed design of the drill head.

An advantageous further development and improvement of the drilling tool according to the main claim is possible by the measures stated in the sub-claims. According to the design according to sub-claim 2, in the case of a double-fluted twist drill, the carbide cutting tip is arranged perpendicular to the flute runout surface in order to produce a symmetrical drill head.

The further embodiment according to sub-claim 3 provides that the lateral area of the receptacle for the carbide cutting tip is ground, but with the cross-section of the drill material not being weakened in the groove root of the carbide cutting tip receptacle. The maximum shearing forces occur in this area when the drill head is subjected to load.

Figure 4B:
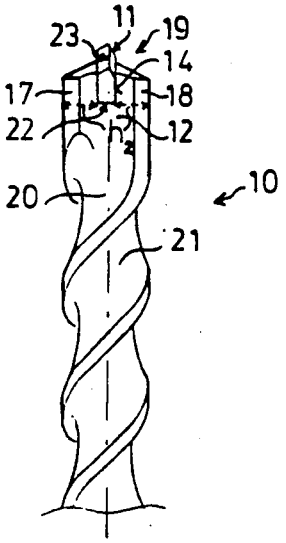
Figure 4C:
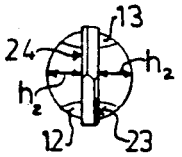
Figure 5A:
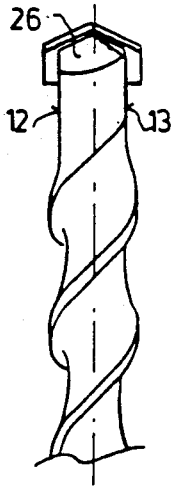
Figure 5B:
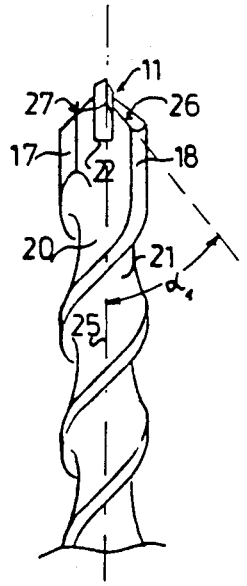
Figure 5C:
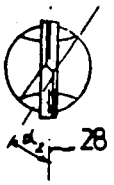

The invention is described in greater detail in the following description and with reference to the figures, in which;

FIGS. 1*a* to 1*c* show the embodiment of drilling tools according to the state of the art, FIG. 2 shows a diagrammatic representation of the drilling tool according to the invention, FIG. 3 shows a representation of the moments of resistance in various designs, FIGS. 4*a* to 4*c* show an illustrative embodiment of the invention in diagrammatic representation, FIGS. 5*a* to 5*c* show a further illustrative embodiment of the invention having a ground drill head.

In the state of the art schematically shown in FIGS. 1*a* to 1*c*, the carbide cutting tip 11 is inserted into the spiral fluting of a double-fluted drilling tool in such a way that it is arranged parallel to the two flute runout surfaces 12 and 13. The webs 15 and 16 arranged on both sides of the recessed groove 14 for receiving the carbide cutting tip 11 are kept very narrow in their effective shearing area. The web surfaces 15 and 16, in order to increase their moment of resistance, are made in a wedge shape according to FIGS. 1*b* and 1*c* (15', 15'', 16', 16''). However, the measures according to FIGS. 1*b* and 1*c* are not adequate to prevent the drill head from shearing off in the area of the groove root of the recessed groove 14.

According to the invention, the carbide cutting tip 11—as shown in FIG. 2—is therefore arranged transversely to the flute runout surface 12 and 13. In this way, the entire remaining circular cross-section, formed by the webs 17 and 18, is available to the side of the carbide cutting tip.

In the representation according to FIG. 3, the different moments of resistance according to the embodiment according to FIG. 1 (state of the art) and FIG. 2 (invention) are compared. According to the representation according to FIG. 1*a*, the area $h_1 \times b_1$ having a moment of resistance of $$W_1 = 1/6 \times (b_1 \times h_1 2)$$

results as an effective area for calculating the moment of resistance. The moment of resistance according to the representation in FIG. 2 results from the area $h_2 \times b_2$ and from this comes a moment of resistance $W_2 = 1/6$ $(b_2 \times h_2 2)$.

It can be seen from this that the web width to the side of the carbide cutting tip 11 (here $h_1$ and $h_2$) enters into the formula for the moment of resistance as a square value. To prevent the webs 17 and 18 from shearing off, they must therefore be made as wide as possible, which is achieved according to the invention by the carbide cutting tip 11 being arranged transversely to the flute runout of the spiral fluting.

A schematic representation of the invention is also shown in FIGS. 4*a* to 4*c*. As can be seen from FIG. 4*b*, the drilling tool 10 according to the invention has a drill head 19, in which the carbide cutting tip 11 is arranged transversely or perpendicular to the flute runout surfaces 12 and 13 of the spiral flutes 20 and 21. In this way, the complete remaining material thickness $h_2$ of the drill material is available at the root 22 of the recessed groove 14, so that a high moment of resistance against shearing off or against vibration fracture results in this area.

FIG. 4*a* shows a side view of the representation according to FIG. 4*b*. In FIG. 4*c*, the drill head 19 is shown in plan view, with the drilling dust flutes 12 and 13 being shown which are formed by the flute runout surfaces of the spiral flutes 20 and 21. The two cutting edges 23 and 24 of the carbide cutting tip 11 are also shown (See also FIG. 4*a*.)

In the illustrative embodiment according to FIGS. 5*a* to 5*c*, the lateral areas 17 and 18 for supporting the carbide cutting tip 11 are made with a ground finish. The grinding angle $\alpha_1$, relative to the drill longitudinal axis 25, is about 20° to 40°, in particular 30°. Furthermore, the surfaces 26 and 27 thus ground run relative to the longitudinal plane 28 of the carbide cutting tip 11 and an acute angle $\alpha_2 \approx 15°$ to 30°, in particular $\alpha_2 = 20°$. However, the full material thickness of the helical diameter is available to the side of the carbide cutting tip at the level of the groove root 22 of the recessed groove 14. The drilling dust is transported via the flute runout surfaces of the spiral flutes 20 and 21.

What is claimed is:

1. A drilling tool in combination with a carbide cutting tip for percussion drilling machines, said drilling tool having a longitudinal dimension and a cutting end and said carbide cutting tip being inserted into said cutting end of said tool and being secured to said tool, said tool having a cylindrical surface interrupted only by double helical fluting which is terminated at the vicinity of said cutting end, in two diametrically opposed flute runout surfaces extending substantially parallel to the longitudinal dimension of said tool, wherein said runout surfaces are in mirror symmetry to a second plane parallel to the longitudinal dimension of said tool, and said cutting tip extends substantially perpendicularly to the second plane.

2. Drilling tool as claimed in claim 1, wherein, the carbide cutting tip has lateral ends (11) projecting past the flute runout surfaces (12,13).

3. Drilling tool as claimed in claim 1 wherein: the tip has two parallel sides extending perpendicularly to the flute runout surfaces; the tool has two web parts at the cutting end of the tool, which web parts are adjacent the sides of the tip; the web parts are ground at an angle $\alpha_1 \approx 20°$ to 40° relative to the longitudinal dimension of the tool; and the web parts have surfaces adjacent the sides of the tip which are ground to have edges that are at an angle $\alpha_2 \approx 15°$ to 30° to the sides of the tip.

4. Drilling tool as claimed in claim 3 wherein $\alpha_1 = 30°$ and $\alpha_2 = 20°$.

5. Drilling tool as claimed in claim 1 wherein the tool is provided at the cutting end with a groove having a groove bottom, the tip is inserted into the groove, and the tool has two web parts adjacent the cutting end and extending perpendicular to the longitudinal dimension of said tool, which web parts are dimensioned, perpendicular to the longitudinal dimension of the tool, to have an effective moment of resistance at the level of the groove bottom which is not weakened by the flute runout surfaces.

* * * * *